United States Patent [19]

Laurello

[11] Patent Number: 4,643,638

[45] Date of Patent: Feb. 17, 1987

[54] STATOR STRUCTURE FOR SUPPORTING AN OUTER AIR SEAL IN A GAS TURBINE ENGINE

[75] Inventor: Vincent P. Laurello, Guilford, Conn.

[73] Assignee: United Technologies Corporation, Hartford, Conn.

[21] Appl. No.: 564,432

[22] Filed: Dec. 21, 1983

[51] Int. Cl.[4] ..... F01D 25/26; F03D 11/00; F28F 7/00

[52] U.S. Cl. ..... 415/136; 415/170 R; 415/175

[58] Field of Search ..... 60/226.1, 262, 266, 60/39.07, 39.75; 415/115, 116, 117, 136, 137, 138, 139, 170 R, 175, 177, 178, 180

[56] References Cited

U.S. PATENT DOCUMENTS

| | | | |
|---|---|---|---|
| 3,443,791 | 5/1969 | Sevetz et al. | 253/39.1 |
| 3,656,862 | 4/1972 | Rahaim et al. | 415/171 |
| 3,742,705 | 7/1973 | Sifford | 60/39.66 |
| 3,800,864 | 4/1974 | Hauser et al. | 165/47 |
| 3,807,891 | 4/1974 | McDow et al. | 415/116 |
| 3,966,352 | 6/1976 | White et al. | 415/115 |
| 4,019,320 | 4/1977 | Redinger, Jr. et al. | 60/226 R |
| 4,023,919 | 5/1977 | Patterson | 415/134 |
| 4,069,662 | 1/1978 | Redinger, Jr. et al. | 60/39.75 |
| 4,101,242 | 7/1978 | Coplin et al. | 415/134 |
| 4,217,755 | 8/1980 | Williams | 60/39.75 |
| 4,230,436 | 10/1980 | Davison | 415/1 |
| 4,247,248 | 1/1981 | Chaplin et al. | 415/136 |
| 4,279,123 | 7/1981 | Griffin et al. | 60/226 R |
| 4,314,791 | 2/1982 | Weiler | 415/115 |
| 4,337,016 | 6/1982 | Chaplin | 415/116 |
| 4,363,599 | 12/1982 | Cline et al. | 415/136 |
| 4,485,620 | 12/1984 | Koenig et al. | 60/39.75 |

*Primary Examiner*—Louis J. Casaregola
*Assistant Examiner*—Donald E. Stout
*Attorney, Agent, or Firm*—Gene D. Fleischhauer

[57] ABSTRACT

A stator structure 34 for supporting an outer air seal 46 is disclosed. Various construction details which adapt the stator structure to evenly move inward and outward in response to the impingement of cooling air are developed. In one embodiment an upstream support ring and a downstream support ring for the outer air seal are attached together.

4 Claims, 3 Drawing Figures

STATOR STRUCTURE FOR SUPPORTING AN OUTER AIR SEAL IN A GAS TURBINE ENGINE

DESCRIPTION

1. Technical Field

This invention relates to gas turbine engines and more particularly to a stator structure for supporting an outer air seal about an array of rotor blades in such an engine. The concepts of this invention were developed in the field of axial flow gas turbine engines and have application to stator structures in other fields.

2. Background Art

Axial flow gas turbine engines generally include a compression section, a combustion section and a turbine section. A rotor extends axially through the sections of the engine. A stator extends axially to circumscribe the rotor. An annular flow path for hot, working medium gases extends through the engine between rotor and the stator. As the gases are flowed through the engine, the gases are compressed in the compression section, burned with fuel in the combustion section and expanded through the turbine section to produce useful work.

The rotor in the turbine section has a rotor assembly for extracting useful work from the hot, pressurized gases. The rotor assembly includes a rotor disk and a plurality of rotor blades which extend outwardly across the working medium flow path.

The stator in the turbine section includes a segmented outer air seal which is positioned about the array of rotor blades to block the leakage of working medium gases over the tips of the blades. The stator has a stator structure, which includes an outer case, for radially supporting and positioning the outer air seal about the array of rotor blades. The outer air seal is spaced radially from the array of rotor blades leaving a clearance gap therebetween. The clearance gap is provided to avoid destructive interference between the rotor blades and outer air seal.

In modern engines, the clearance gap between the rotor blades and the outer air seal is modulated to minimize the clearance during various operating conditions of the engine. Examples of engines employing external constructions to modulate the tip clearance are shown in U.S. Pat. No. 4,019,320 issued to Redinger et al. entitled "External Gas Turbine Engine Cooling For Clearance Control" and U.S. Pat. No. 4,247,248 issued to Chaplin et al. entitled "Outer Air Seal Support Structure For a Gas Turbine Engine," the material in which is incorporated herein by reference. In Redinger and Chaplin, the diameter of the outer air seal about the array of rotor blades, and thus the clearance gap, is adjusted by selectively cooling a portion of the case.

As shown in Redinger and Chaplin, each outer air seal is provided with a stator support structure that includes an upstream support ring and a downstream support ring. The engine case has a circumferentially extending rail adjacent to the upstream support ring and a second circumferentially extending rail adjacent to the downstream support ring. Cooling air is impinged on the rails. As the cooling air carries heat away from the external rails, the external rails contract and force the internal support structure to a smaller diameter. The internal support structure is circumferentially slideable with respect to the outer case and the array of outer air seal segments to accommodate the large changes in diameter. Turning off the cooling air allows the rails to expand with a concomitant increase in the diameter of the internal support structure and the outer air seal.

As the clearance between the outer air seal and the rotor blade is changed, the upstream and downstream support rings must move by the same amount to avoid tilting from front to back of the outer air seal segments. For example, tilting of the segments might occur because of unexpected axial temperature gradient in the outer case between rails or as the upstream rail is unexpectedly cooled more than the downstream rail decreasing the clearance gap at the front of the seal with respect to the back. An unpredicted decrease in the clearance gap between the outer air seal and the rotor blade may cause a destructive interference between the rotor blade and the outer air seal with a corresponding decrease in the performance of the engine or even the loss of a rotor blade.

Tilting of the segments might occur at the downstream rail, for example, because of the unpredicted leakage of gases from the interior of the case to the exterior of the case through a flange at the rail. The unexpected leakage causes heating of the flange and an increase in the clearance at the back of the seal with respect to the front. A larger than expected gap between the rotor blade and the outer air seal may cause a decrease in the efficiency of the engine because of the increased leakage of working medium gases over the tips of the rotor blades.

The amount of cooling air required to cool the upstream rail and the downstream rail is also important. The cooling air that is impinged on the coolable rails is pressurized to an extent that enables the air to flow from spray bars to the rail. One source of pressurized cooling air is the compression section of the engine. As the working medium gases are passed through the fan section, a portion of the pressurized gases (air) are removed from the working medium flow path and ducted to spray bars. Because the cooling air is removed from the working medium flow path after energy is expended by the engine to pressurize the gases, it is desirable to reduce the amount of cooling air needed for clearance control.

Accordingly, scientists and engineers are searching for ways to decrease the need for pressurized cooling air and to avoid uneven movement of the outer air seal in the radial direction to avoid variations in the gap between the outer air seal and the rotor blade.

DISCLOSURE OF INVENTION

According to the present invention, a stator structure in a gas turbine engine having a coolable rail which extends about an outer case for positioning an outer air seal about an array of rotor blades includes an upstream support ring and a downstream support ring for the outer air seal which are attached to the outer case at an axial location adjacent to the coolable rail to cause the support rings to act together.

A primary feature of the present invention is a coolable rail which extends circumferentially about an outer case. Another feature is a segmented outer air seal. A feature is a segmented upstream support ring and a segmented downstream support ring. Each has a plurality of support segments. The plurality of upstream support segments and the plurality of downstream support segments slideably engage the outer case and extend from the outer case to the outer air seal. Another primary feature is a means for attaching the upstream and downstream support segments at an axial location which is adjacent to the coolable rail. In one detailed embodiment, one of the support rings is integral with an array of stator vanes. Rib and groove connections are used to join the ends of the array of outer air seals to the platforms of the array of stator vanes.

A primary advantage of the present invention is the engine efficiency which results from blocking the leakage of working medium gases over the tips of an array of rotor blades with a segmented outer air seal. The segmented outer air seal has upstream and downstream support rings which are moved by the same amount to avoid tilting of the segments from front to rear as the support rings and the outer air seal are moved inwardly and outwardly by a coolable rail. Another advantage of the present invention is the engine efficiency which results from the efficient use of cooling air by using a single coolable rail to position the upstream and downstream ends of an array of outer air seals. In one embodiment, an advantage of the present invention is the reduction in the number of parts in the engine by employing a single rail to position the outer air seal and by supporting the end of an array of outer air seals and the end of an array of stator vanes with the same support ring.

The foregoing features and advantages of the present invention will become more apparent in the light of the following detailed description of the best mode for carrying out the invention and in the accompanying drawing.

BEST MODE FOR CARRYING OUT THE INVENTION

Figure 1:
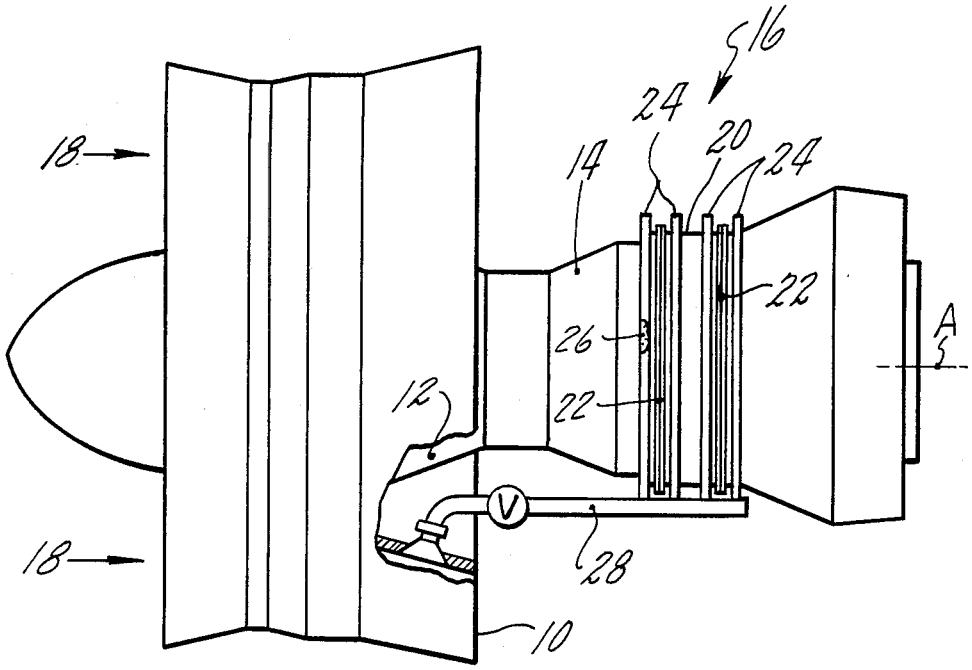
FIG. 1 is a side elevation view of a turbofan engine with a portion of the fan case broken away to show a cooling air duct.

FIG. 1 shows a turbofan, axial flow gas turbine engine embodiment of the invention. The engine includes a fan section 10, a compression section 12, a combustion section 14 and a turbine section 16. The engine has an axis of rotation A and an annular flow path 18 for working medium gases which extends axially through these sections of the engine. A coolable outer case 20 extends circumferentially about the working medium flow path. The outer case in the turbine section of the engine has at least one coolable rail 22 integral with the outer case which extends circumferentially about the exterior of the outer case. A means for impinging cooling air on the rails, such as a plurality of spray bars 24, extends circumferentially about the exterior of the case. A multiplicity of cooling air holes 26 places the interior of each bar in flow communication with an associated rail. A duct 28 for cooling air extends rearwardly from the fan section of the engine and is in flow communication with the spray bars to provide a source of cooling air to the coolable rails.

Figure 2:
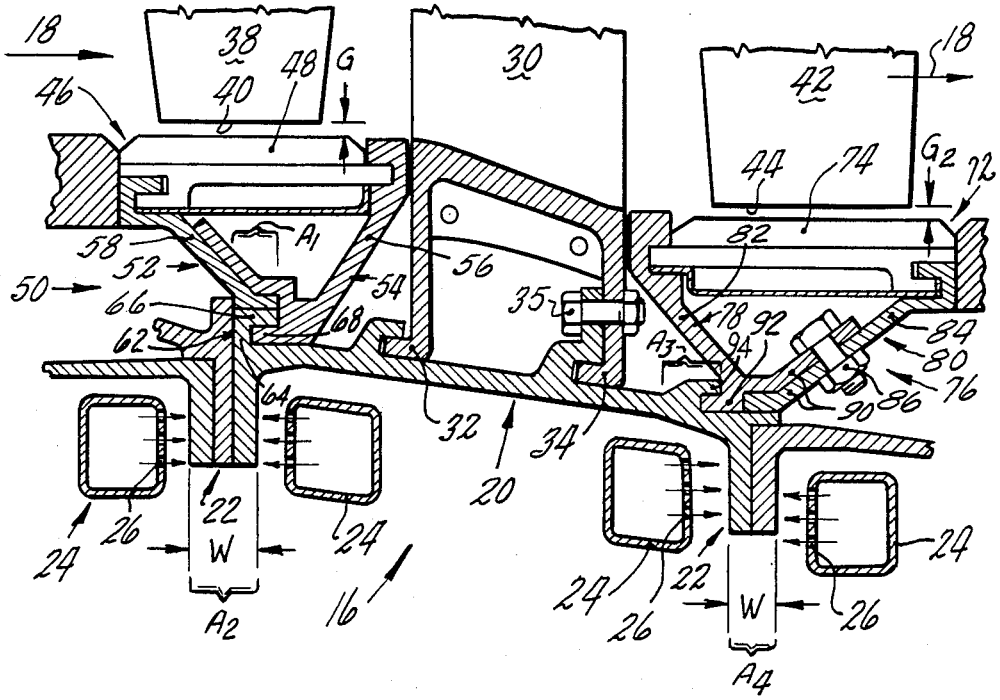
FIG. 2 is a cross-sectional view of a portion of the turbine section of the engine.

FIG. 2 is a cross-sectional view of a portion of the turbine section 16 of the engine showing part of the outer case 20 and the annular flow path 18 for hot working medium gases. An array of stator vanes, as represented by the single stator vane 30, extends radially inwardly from the outer case across the working medium flow path. Each stator vane has an upstream foot 32 which slideably engages the outer case and a downstream foot 34. The downstream foot is attached to the outer case by a suitable means, such as the nut and bolt combination 35.

The turbine section 16 includes a first array of rotor blades, as represented by the single rotor blade 38. The first rotor blade 38 terminates in a tip 40 which is axially oriented, that is, extends in a generally axial direction. A second array of rotor blades, as represented by the single rotor blade 42, is spaced radially from the first array of rotor blades to form alternate arrays of rotor blades and stator vanes. The second rotor blade terminates in a tip 44 which is axially oriented.

The first rotor blade 38 and the second rotor blade 42 extend outwardly across the annular flow path 18 into proximity with the coolable outer case 20. A first outer air seal 46 extends circumferentially about the first array of rotor blades and is spaced radially from the rotor blades leaving a radial gap G therebetween. The outer air seal is formed of an array of arcuate seal segments, as represented by the single seal segment 48. A stator structure 50 for radially supporting and positioning the array of outer seal segments engages the segments. The stator structure includes an upstream support ring 52 and a downstream support ring 54. The downstream support ring has a frustoconical shape and is formed of a plurality of downstream support segments, as represented by the single downstream support segment 56. Each downstream support segment engages the outer air seal and is circumferentially slideable with respect to the outer air seal. Each downstream support segment extends from the outer air seal to the outer case 20 and slideably engages the outer case. In the embodiment shown, the center of the downstream support segment is free to move circumferentially. Alternatively, a center bolt (not shown) in the downstream support segment might prevent the center portion of the downstream support segment from shifting circumferentially with respect to the case. Nevertheless, the ends of each segment are free to move circumferentially and the support segment is circumferentially slideable with respect to the outer air seal and the outer case.

The upstream support ring 52 is frustoconical in shape and is formed of a plurality of upstream support segments, as represented by the single upstream support segment 58. Each upstream support segment is trapped by the outer case 20 and an associated downstream support segment 56. Each upstream support segment slideably engages the outer case and extends from the outer case to the outer air seal to engage the outer air seal. Each upstream support segment is circumferentially slideable with respect to the outer air seal 46.

An inner flange 62 is provided. The inner flange is an example of a means for attaching the plurality of upstream support segments 58 and the plurality of downstream support segments 56 to the outer case 20. The flange attaches the segments to the outer case at a first axial location $A_1$. The flange includes a shoulder 64 and a hook 66. Each upstream support segment is trapped between the flange on the case and an associated downstream support segment 56. The downstream support segment is adapted by a hook 68 to slideably engage in the circumferential direction the circumferentially extending hook 66 on the outer case. In the embodiment shown, the flange 62 is integral with the outer case. Other satisfactory constructions are contemplated which might employ a means for attaching the upstream and downstream support segments which is not integral with the outer case (such as a second set of support rings) and yet permits circumferential movement between the upstream and downstream support rings and the outer case.

A coolable rail 22 having an axial width W extends circumferentially about the exterior of the outer case at a location $A_2$ which is axially adjacent to the first axial location $A_1$. The term "adjacent" means that the axial location of the flange lies within a distance D which is less than the width W of the rail. In the embodiment shown, the axial location $A_2$ of the rail 22 and the first axial location $A_1$ overlap.

The second array of rotor blades 42 extends outwardly across the annular flow path 18 into proximity with the coolable outer case 20. A second outer air seal 72 extends circumferentially about the array of rotor blades and is spaced radially from the rotor blades by a gap $G_2$. The second outer air seal is formed of an array of arcuate seal segments 74. A stator structure 76 of the same type as the stator structure 50 radially supports and positions the array of arcuate segments about the array of rotor blades. The stator structure includes an upstream support ring 78 and a downstream support ring 80. The upstream support ring is frustoconical in shape and is formed of a plurality of circumferentially extending segments, as represented by the single segment 82. The downstream support ring is frustoconical in shape and is formed of a plurality of downstream support segments, as represented by the single downstream support segment 84. A nut and bolt combination 86, or other suitable means, are employed to make each upstream support segment integral with an associated downstream support segment to form a pair of associated segments 90. Each pair of segments has a circumferentially extending hook 92. A hook 94 at a first axial location A3 on the outer case provides a means for attaching the support segments to the outer case and adapts the case to slideably engage in the circumferential direction the circumferentially extending hook of the pair of support segments. A coolable rail 22 having a width W extends circumferentially about the exterior of the outercase at a location A4 which is axially adjacent to the first axial location A3.

Figure 3:
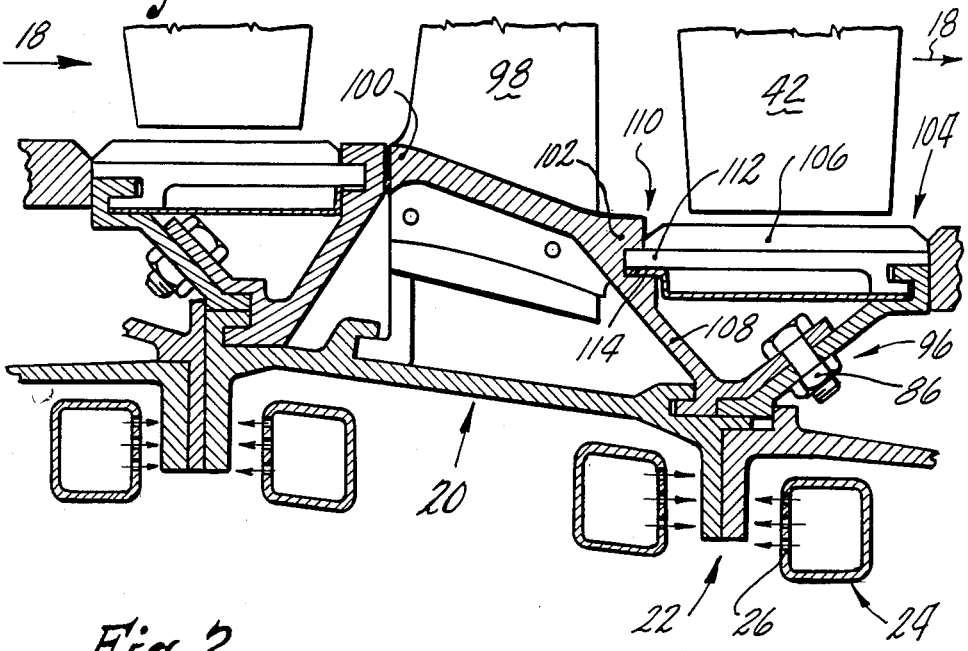
FIG. 3 is an alternate embodiment of the turbine section shown in FIG. 2.

FIG. 3 shows a stator structure 96 which is an alternate embodiment of the stator structure 76 shown in FIG. 2. The stator structure includes an array of stator vanes 98 having an upstream end 100 and a downstream end 102. An outer air seal 104 is formed of a plurality of arcuate seal segments 106. This embodiment of the stator structure differs from the stator structure 76 in that the plurality of upstream support segments 108 extend from the outer case to the downstream end of the array of stator vanes to support the array of stator vanes. In the embodiment shown, each segment 108 of the plurality of upstream support segments is integral with at least one stator vane 98. Each arcuate seal segment is adapted to engage the downstream end of the stator vane with a rib and groove construction 110. In the embodiment shown, each arcuate seal segment has a rib 112. Each vane has a groove 114.

During operation of the gas turbine engine, hot working medium gases are flowed from the combustion section 14 to the turbine section. The hot, pressurized gases are expanded in the turbine section 16. As the gases are flowed along the annular flow path 18, heat is transferred from the gases to components in the turbine section. The arrays of rotor blades are bathed in the hot working medium gases and respond more quickly than does the outer case which is more remote from the working medium flow path. As a result, the radial gap G between the rotor blades and the outer air seal varies. An initial clearance is provided to accommodate this rapid expansion of the blades and disk. As time passes, the outer case receives heat from the gases and expands away from the rotor blades, increasing the gap G.

The gap G between the array of rotor blades 98 and the outer air seal is regulated by impinging cooling air on the coolable rail 22 to cause the coolable rail to contract and to move the outer air seal in closer to the array of rotor blades. Because the rail 22 moves both the upstream support and the downstream support, the supports move together and by the same radial amount to avoid tilting of the segments from front to rear. The tilting of the segments will cause an uneven variation in the gap between the axially extending tips of the rotor blade and the outer air seal and will either decrease or increase the clearance by an amount not anticipated. As a result of tilting, destructive contact between the rotor blade and the air seal may occur if an unexpected decrease in the gap occurs or if an increase occurs, a larger than normal amount of working medium gases may pass over the tips of the rotor blade decreasing the efficiency of the engine.

As a result of using only one coolable rail to position the upstream and downstream ends of the array of outer air seal segments, less cooling air is used as compared with constructions requiring two different coolable rails. Because energy is expended by the engine to compress the cooling air, a decrease in the use of cooling air improves the efficiency of the engine in comparison with those constructions which require more rails to position the array of outer air seals. Finally, by employing a single rail to position the outer air seal, a smaller amount of spray tubes and supporting hardware is required. With respect to the FIG. 3 embodiment, a further reduction in the number of parts results from combining the support for the array of outer air seals with the support for the array of stator vanes.

Although the invention has been shown and described with respect to detailed embodiments thereof, it should be understood by those skilled in the art that various changes in form and detail thereof may be made without departing from the spirit and the scope of the claimed invention.

I claim:

1. In an axial flow gas turbine engine of the type having an axis of rotation A, an annular flow path for working medium gases, a coolable outer case which extends circumferentially about the working medium flow path and a turbine section through which the working medium gases are passed, the turbine section including an array of rotor blades extending outwardly across the working medium flow path, each rotor blade terminating in an axially oriented tip, and an outer air seal formed of an array of arcuate seal segments which extend circumferentially about the flow path and which are spaced radially from the tips of the rotor blades leaving a gap G therebetween, the improvement which comprises:

a stator structure for radially supporting and positioning the array of outer air seal segments which includes an upstream support ring formed of a plurality of upstream support segments which engage the segments of the outer air seal, which are circumferentially slideable with respect to the outer air seal and which extend from the outer air seal to the outer case;

a downstream support ring formed of a plurality of downstream support segments which engage the outer air seal, which are circumferentially slideable with respect to the outer air seal and which extend from the outer air seal to the outer case;

means for attaching the plurality of upstream support segments and the plurality of downstream support segments to the outer case at one axial location;

a single coolable rail integral with the outer case which extends circumferentially about the exterior of the outer case at a location which is axially adjacent to said one axial location, means for impinging cooling air on the coolable rail;

wherein movement of the coolable rail in response to cooling air impinged on the coolable rail uniformly adjusts the radial gap G between the outer air seal and the axially extending tips of the array of rotor blades by causing the upstream and downstream support rings of the outer air seal to move together by the same radial amount.

2. The stator structure of claim 1 which further includes an array of stator vanes having an upstream end and a downstream end and wherein one of said pluralities of support segments extends from the outer case to one of said ends of the array of stator vanes to support the array of stator vanes.

3. The stator structure of claim 2 wherein each segment of the plurality of support segments which extend to the end of the array of stator vanes is integral with at least one of said stator vanes.

4. In an axial flow gas turbine engine of the type having an axis of rotation A, an annular flow path for working medium gases, a coolable outer case which extends circumferentially about the working medium flow path and a turbine section through which the working medium gases are passed, the turbine section including an array of rotor blades extending outwardly across the working medium flow path, each rotor blade terminating in an axially oriented tip, and an outer air seal formed of an array of arcuate seal segments which extend circumferentially about the flow path and which are spaced radially from the tips of the rotor blades leaving a gap G therebetween, the improvement which comprises:

a stator structure for radially supporting and positioning the array of outer air seal segments which includes an upstream support ring which is frustonconical in shape, the upstream support ring being formed of a plurality of upstream support segments which engage the segments of the outer air seal, which are circumferentially slideable with respect to the outer air seal and which extend from the outer air seal to the outer case;

a downstream support ring which is frustoconical in shape, the downstream support ring being formed of a plurality of downstream support segments which engage the outer air seal, which are circumferentially slideable with respect to the outer air seal and which extend from the outer air seal to the outer case;

means for attaching the plurality of upstream support segments and the plurality of downstream support segments to the outer case at one axial location;

a coolable rail integral with the outer case which extends circumferentially about the exterior of the outer case at a location which is axially adjacent to said one axial location means for impinging cooling air on the coolable rail;

wherein each segment of the upstream support ring is integral with an associated segment of the downstream support ring to form a pair of segments, wherein each pair of segments has a circumferentially extending hook, wherein the means for attaching the support segments to the outer case is a hook which extends circumferentially about the interior of the outer case which adapts the case to slideably engage in the circumferential direction the circumferentially extending hook of a pair of support segments; and, wherein movement of the coolable rail in response to cooling air impinged on the coolable rail uniformly adjusts the radial gap G between the outer air seal and the axially extending tips of the array of rotor blades by causing the upstream and downstream support rings of the outer air seal to move together by the same radial amount.

* * * * *